United States Patent [19]

Thompson

[11] Patent Number: 4,829,156

[45] Date of Patent: May 9, 1989

[54] ELECTRIC CURLING IRON HAVING A REVERSIBLE MOTOR-DRIVEN ROTATABLE CURLING MANDREL

[76] Inventor: Robert I. Thompson, 1653 Ray Blvd., Traverse City, Mich. 49684

[21] Appl. No.: 40,256

[22] Filed: Apr. 15, 1987

[51] Int. Cl.[4] ..... H05B 1/02; A45D 2/12; A45D 2/36; A45D 6/04

[52] U.S. Cl. ..... 219/225; 219/230; 219/533; 132/232; 132/238

[58] Field of Search ..... 219/222–226, 219/230, 533; 132/34 R, 34 A, 34 B, 37 R, 37 A, 31 R, 31 A, 32 R, 32 B, 11 R, 11 A, 7, 9

[56] References Cited

U.S. PATENT DOCUMENTS

| | | | |
|---|---|---|---|
| 2,192,890 | 3/1940 | Boda | 219/225 X |
| 2,448,263 | 8/1948 | Hannon | 132/34 R |
| 2,524,058 | 10/1950 | Kamara | 132/34 R |
| 2,608,195 | 8/1952 | Ledbetter | 132/34 R |
| 2,935,070 | 5/1960 | Auz | 132/37 R |
| 3,459,199 | 8/1969 | Connell | 132/11 R |
| 3,533,421 | 10/1970 | Mays | 219/226 X |
| 3,854,489 | 12/1974 | Doyle | 219/222 X |
| 4,211,914 | 7/1980 | Jackson | 219/225 |
| 4,267,431 | 5/1981 | Rick | 219/225 |
| 4,442,849 | 4/1984 | Kawabe | 132/37 R |
| 4,549,560 | 5/1986 | Inoue | 219/225 |

FOREIGN PATENT DOCUMENTS

| | | | |
|---|---|---|---|
| 1084381 | 8/1980 | Canada | 219/225 |
| 53942 | 6/1982 | European Pat. Off. | 219/225 |
| 503001 | 12/1954 | Italy | 219/225 |
| 2106384 | 4/1983 | United Kingdom | 219/225 |

*Primary Examiner*—Anthony Bartis
*Attorney, Agent, or Firm*—Krass & Young

[57] ABSTRACT

An electric curling iron includes a handle containing a reversible DC motor for rotating an elongated, generally cylindrical curling mandrel extending from the front end of the handle and coupled to the motor by a clutch so as to prevent injury to the user. The mandrel is electrically heated and controls are provided on the handle for selecting the speed and direction of mandrel rotation as well as the level of mandrel heating. A clamp for releasably retaining a strand of hair is carried by the mandrel for rotation therewith. A manually activated actuating mechanism on the handle is designed to allow opening and closing of the clamp while the mandrel is rotating.

8 Claims, 3 Drawing Sheets

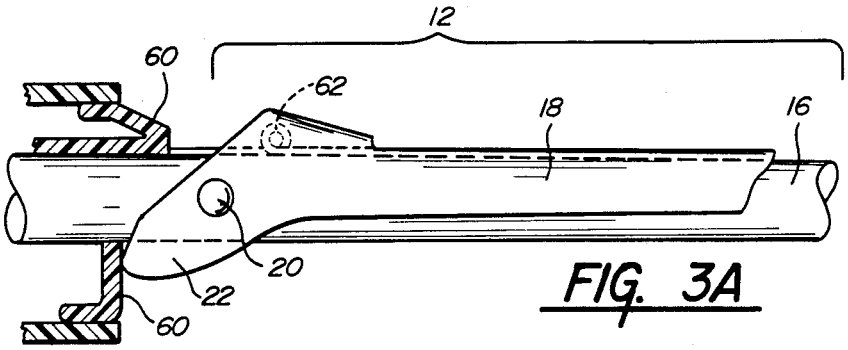
FIG. 3A
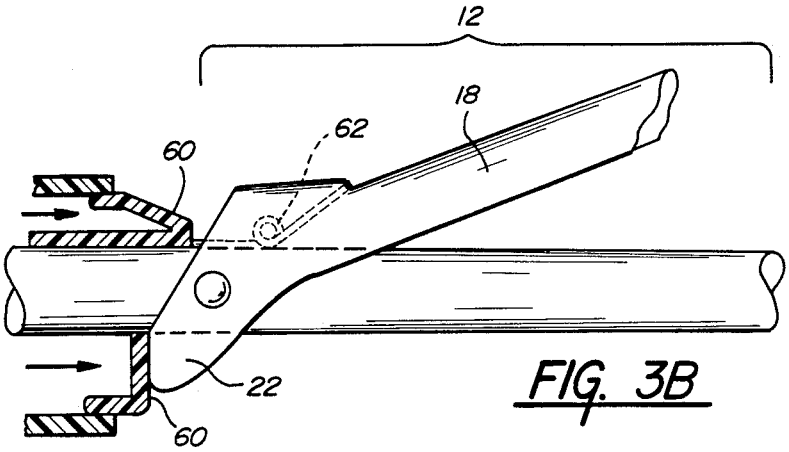
FIG. 3B
FIG. 4A
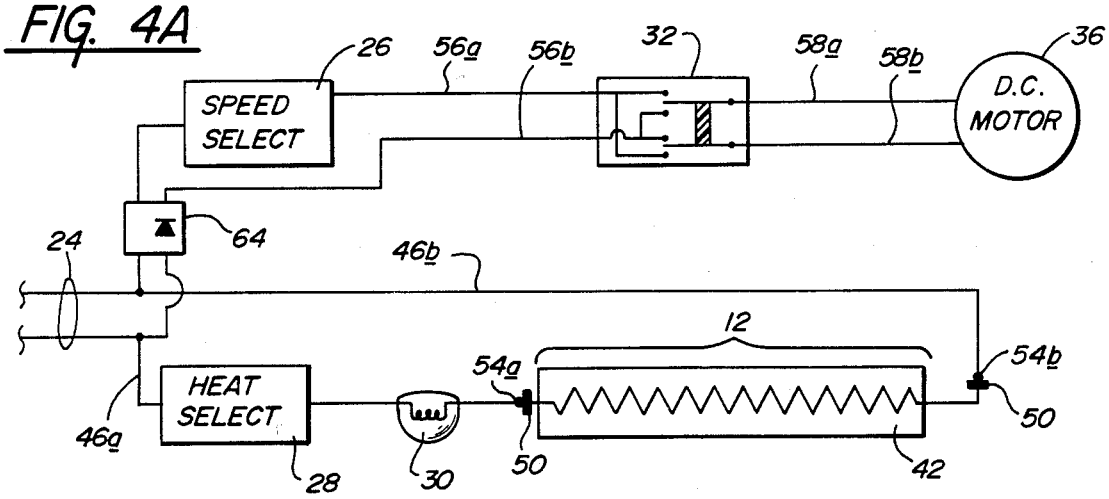
FIG. 4B
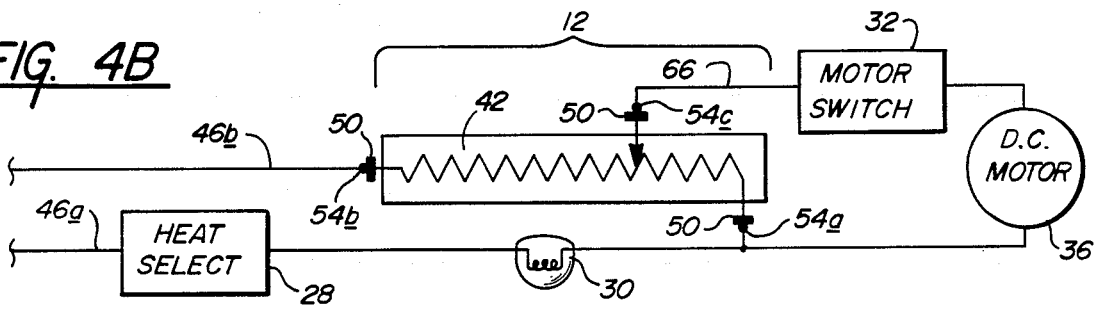

ELECTRIC CURLING IRON HAVING A REVERSIBLE MOTOR-DRIVEN ROTATABLE CURLING MANDREL

FIELD OF THE INVENTION

This invention relates generally to hair styling appliances and particularly to curling irons. The curling irons of the present invention are electrically heated and include an electric motor to provide for the winding or unwinding of hair thereby.

BACKGROUND OF THE INVENTION

Styling of the hair is one of the earliest human endeavors directed toward the enhancement of personal appearance. Hairstyles have been used since time immemorial for aesthetic appeal, as well as to signify group membership or as a mark of rank or status. Curling is an operation of primary importance in the styling of hair.

Hair curling is often accomplished by the use of curling irons; and, the typical curling iron includes a curling mandrel comprised of a generally cylindrical, elongated curling bar having a clamping member adapted to fit about a portion of the circumference thereof for at least a portion of the length thereof. In use, the curling iron is heated and a strand of hair is clamped against the bar by the clamping member. Rotation of the entire curling iron winds the remainder of the strand of hair about the mandrel. The heat in the mandrel alters the texture of the hair so as to curl it and after a predetermined amount of time, the curled hair is unwound.

Curling irons are at present generally electrically heated although previously direct flame had been employed for this purpose. One of the greatest difficulties encountered in the use of a curling iron is that of winding the hair about the mandrel. Winding is typically a slow process in which the entire curling iron must be rotated. Such winding requires the use of two hands thereby making it difficult for a person to set their on hair. Furthermore, since the degree of curl is dependent upon the temperature of the mandrel and the time of contact therewith, such winding should be rapidly accomplished in order to allow for uniform curl formation. Accordingly, there is a need for a curling iron having a driven mandrel which will simplify the winding of the hair thereabout.

European Patent Application No. 053,942 published June 16, 1982 discloses a curling iron having a mechanical linkage for effecting rotation of the mandrel thereof. According to the disclosure, a curling iron may be provided with a spring loaded handle adapted to be squeezed in the manner of shears, and this handle may be geared to rotate a mandrel. While such a device does simplify the winding of hair about a curling iron, such mechanical actuation becomes fatiguing to the operator particularly in commercial settings wherein such apparatus is used for long periods of time. Accordingly, it is desirable that curling irons be provided with motorized means for winding of hair. The aforementioned European patent application briefly discusses the possibility that an electrical motor may be provided for rotating the mandrel, but such disclosure is very brief and does not teach or suggest the manner in which the motor may be disposed, the speed thereof controlled, or the disposition of the component parts thereof.

Electrically rotatable curling irons have heretofore been proposed. However, such prior art devices were generally very complex, bulky units having extensive mechanical linkages and control systems and accordingly have not been adopted by the industry. For example, U.S. Pat. No. 2,524,058 discloses an electrically rotatable curling iron which includes therein a very bulky electric motor necessitating a right angle drive. Canadian Pat. No. 1,084,381 discloses an electrically driven curling iron having a right angle configuration and a complex belt drive system; while U.S. Pat. No. 2,608,195 discloses a similar right angle apparatus having a very large motor and mechanical controls. The fact that such particular, unwieldly apparatus has even been proposed indicates that it is desirable to have electrically driven curling irons. However, such prior art apparatus are bulky and difficult to use and consequently have not met with commercial success.

Accordingly, there is still an unfulfilled need for an electrically driven curling iron which is lightweight and easy to use. The curling iron of the present invention, as will be disclosed herein, is a lightweight, simple to operate apparatus having a linear configuration. That is to say the invention provides a curling iron wherein the mandrel, handle, and all other components thereof are disposed along a common linear central axis. In this regard, the curling iron of the present invention although motor driven, resembles in outward appearances heretofore available manually rotated curling irons. Furthermore, the curling iron disclosed herein includes simple to operate controls for motor speed and temperature setting, and is equally well suited for right or left-handed operation. Accordingly, the curling iron of the present invention fulfills a long-felt need for such an apparatus.

SUMMARY OF THE INVENTION

There is disclosed herein a hair curling appliance which includes a curling mandrel and a handle. The mandrel of the curler comprises an elongated, generally cylindrical curling bar having a circumference and length and adapted to have a strand of hair wound thereabout, as well as a clamping element configured so as to conform to a portion of the circumference of the curling bar for at least a portion of the length thereof. The clamping element is pivotably attached to the curling bar so as to be biasable between a first position wherein the clamping element engages a circumferential portion of the curling bar and a second position wherein the element is pivoted out of engagement with the circumferential portion. The mandrel further includes an electric heater disposed internally of and coaxial with the circumference of the curling bar. The handle of the appliance comprises an outer casing which includes a motor assembly having an electrical motor with a clutch associated therewith as well as an adapter shaft configured so as to engage the mandrel to the clutch and effect rotation thereof relative to the casing. The handle further includes speed selection means adapted to provide a predetermined level of electrical power to the motor, which level corresponds to a preselected mandrel rotational speed, and a motor activation switch interposed in series electrical communication with the speed selection means on the motor and adapted to initiate and terminate the supply of the preselected level of power to the motor. The handle further includes heater control means adapted to provide electrical power to the heater, the amount of power corresponding to a preselected curling bar temperature. The handle also includes clamping element actuating means which include a clamp actuating lever disposed on the outer casing if the handle for purposes of biasing the clamping element between its first and its second position. The outer casing, motor and mandrel of the appliance of the present invention are disposed along a common linear central axis so as to provide a linear hair curling appliance; furthermore, the motor activating switch and the clamp activating lever are disposed in close proximity to one another so as to be sequentially operable by a single digital stroke.

The motor of the hair curling appliance is preferably a direct current motor and the appliance includes a voltage divider adapted to supply a preselected level of direct current energy to the motor. In particular embodiments, the heating element may be employed as a resistive element in the voltage divider.

The clamping element actuator may include a face plate having a central opening therein and disposed so that the mandrel passes through that central opening; the face plate being operably connected to the clamp actuating lever so that depression of the clamp actuating lever translationally displaces the face plate along the central axis of the mandrel wherein it engages a projection on the clamping member so that said translation displacement biases the clamping element from its first to its second position.

In yet other embodiments, the handle may include a slip ring assembly adapted to provide electrical power to the heater while allowing for rotation of the mandrel. In those instances where the heater is utilized as part of the voltage divider network, the slip ring assembly may also provide power to the motor. The handle may be provided with selector switches so as to control the level of heat and the speed of rotation; for example, the switches may be adapted to provide high, medium and low levels of electrical power to the motor and high and low levels to the heater. The motor control switch may also be adapted to control the direction of rotation of the motor.

BRIEF DESCRIPTION OF THE DRAWINGS

FIG. 3A is partial view of the curling mandrel of a curling iron of the present invention illustrating the clamping element thereof as disposed in a first position to retain a strand of hair;

FIG. 3B is a partial view of the mandrel of FIG. 3A depicting the clamping element as biased to a second position adapted to release a strand of hair;

FIG. 4A is a schematic diagram of one embodiment of electrical circuitry for energizing the motor and heater of the curling iron of the present invention; and FIG. 4B is a schematic diagram of an alternative embodiment of electrical circuit as adapted to energize the motor and heater of the curling iron of the present invention.

DETAILED DESCRIPTION OF THE INVENTION

Figure 1:
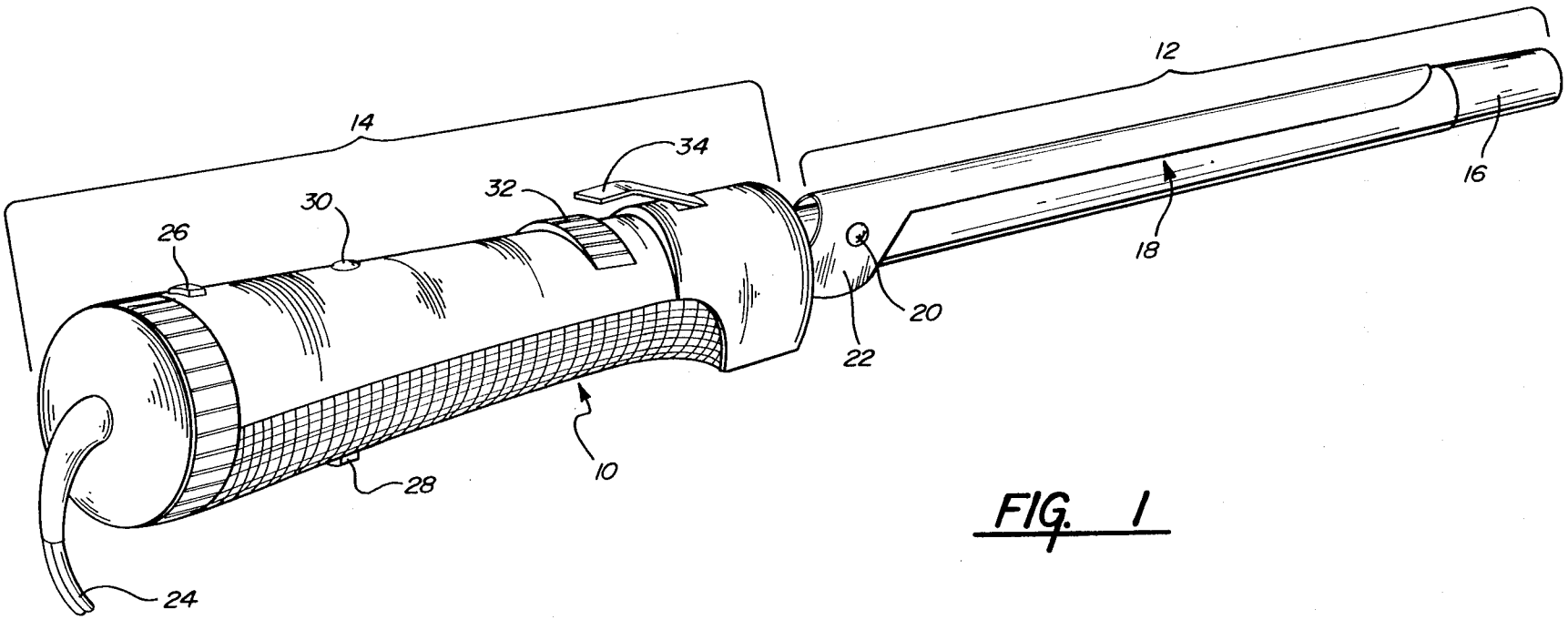
FIG. 1 is a perspective view of a particular curling iron structured in accord with the principals of the instant invention.

Referring now to FIG. 1, there is shown a perspective view of one embodiment of curling iron as structured in accord with the principals of the instant invention. The curling iron 10 generally includes a curling mandrel 12 and a handle portion 14. The mandrel 12 is electrically heated so as to effect the curling of the hair. Additionally, it is motor driven to allow for rotation in a clockwise or counterclockwise direction to aid in rolling of hair thereabout. The mandrel 12 includes an elongated, generally cylindrical curling bar 16 having a clamping element 18 in contact with at least a portion of the circumference thereof. The clamping element 18 is an elongated element pivotably attached to the curling bar 16 at a pivot point 20, and includes a projecting portion 22 disposed so as to contact a movable face plate member, not visible in this view. Translational movement of the projecting portion 22 by the face plate serves to bias the clamping element 18 to an open position wherein the curved portion thereof is pivoted out of engagement with the curling bar, as will be explained in greater detail hereinbelow. The curling bar 16 of the mandrel 12 also includes an electrical heater disposed therein.

The handle portion 14 of the curling iron 10 is provided with a power cable 24 and further includes a rotational speed selection switch 26 for selecting the speed with which the mandrel 12 rotates; a heat level selector switch 28 for selecting the temperature level at which the curling bar 16 is maintained; and an indicator light 30 for indicating when the curling bar 16 is being heated. The handle 14 further includes a motor switch 32 for initiating and terminating rotation of the mandrel 12. The motor switch 32 may further be adapted to control the direction of mandrel rotation. The handle 14 includes a lever 34 adapted to bias the clamping element 18 on the mandrel 12 between an open and closed position to enable retention and release of a strand of hair thereby. It will be noted that the curling iron is configured so that the components thereof are disposed along a common linear central axis so as to provide a linear appliance. It will further be noted that the clamping element actuating lever 34 and the motor activating switch 32 are disposed in close proximity so as to be sequentially operable by a single digital stroke. The particular arrangement of the components of the curling iron readily adapts it for either right or left-handed operation with equal facility.

In the operation of the curling iron, the power cord 24 is connected to a source of electrical energy, the heat level selector switch 28 is adjusted to select an appropriate level of heat, typically a high or low level. The motor speed selection switch 26 is set so as to choose a desired mandrel rotational speed, typically a high, medium or low speed. In order to curl hair, the clamp actuating lever 34 is depressed so as to open the clamping element 18. A portion of a strand of hair is inserted beneath the clamping element and the lever is released so as to retain the strand of hair. The motor actuating switch 32 is then activated so as to rotate the mandrel 12 to wind the hair thereabout.

After a predetermined amount of time sufficient to impart a curled texture to the hair, the motor rotation switch 32 is again activated to reverse the direction in which the mandrel 12 rotates so as to unwind the hair therefrom; the motor control switch 32 is again activated to terminate rotation, and the clamp actuating lever is depressed so as to release the now curled strand of hair.

In a variation of the foregoing, the mandrel 12 may simply be disengaged from the motor at the end of the curling time, so as to be essentially "free wheeling." In this instance a slight pull on the curling iron will allow the mandrel to rotate freely thereby unwinding the curled hair. Such modification is readily made within the scope of the present invention, and are readily accomplished by including a release clutch for disengaging the mandrel 12 from the motor. It will be noted that the close placement of the clamp actuating lever 34 and the motor activating switch 32 allows for sequential operation thereof by a single stroke of a finger. Accordingly, the curling iron of the present invention is readily adapted for easy single handed operation, a factor which is important when repeated high volume use is being made of the curling iron as for example in a commercial setting, or when a person is utilizing the device to curl their own hair. Furthermore the generally linear configuration of the curling iron is similar to presently employed manually rotatable curling irons therefore user acceptability is high; also, the linear design adapts the iron for manual use by allowing for ready manual rotation thereof in those instances where it is desired to so utilize the device.

Figure 2:
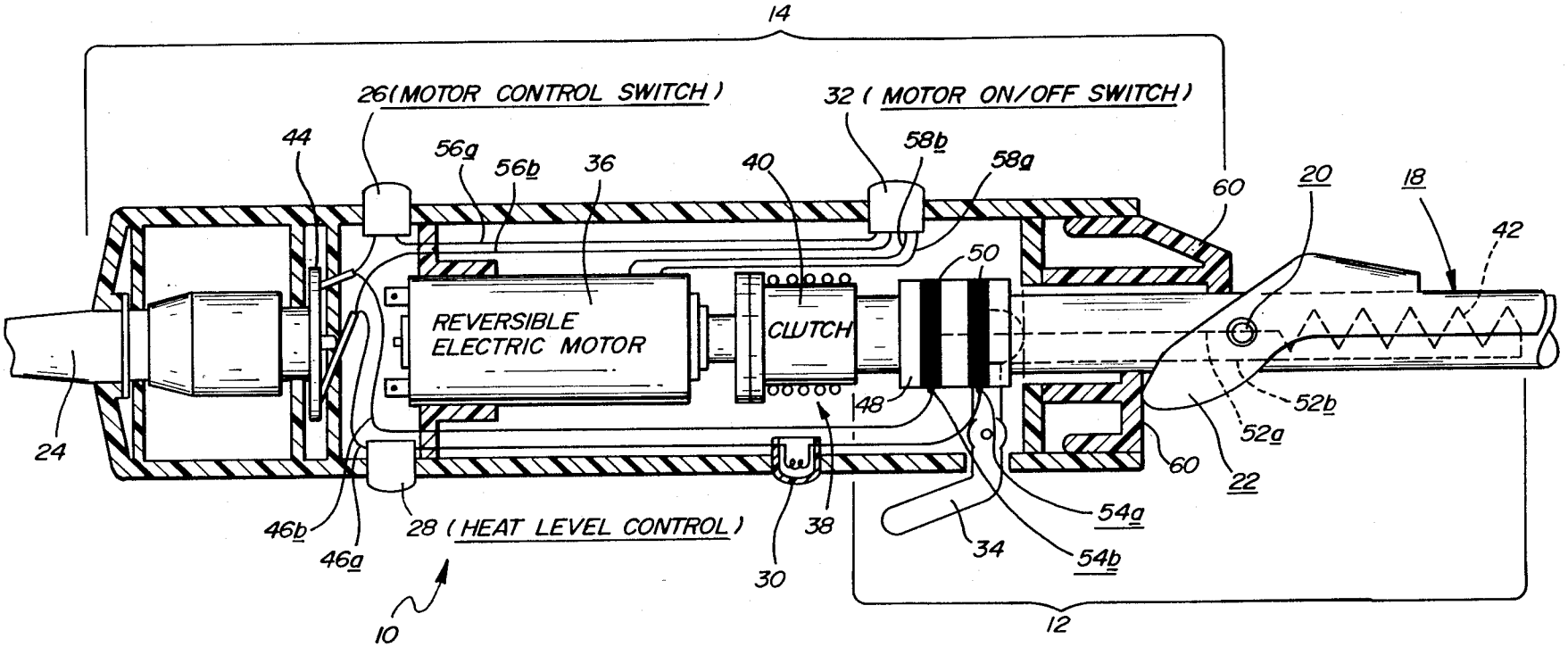
FIG. 2 is a cut-away view of the curling iron of FIG. 1 illustrating in schematic form the major component thereof.

Referring now to FIG. 2, there is shown a cut-away view of a curling iron generally similar to that illustrated with reference to FIG. 1, it showing in schematic form the major components thereof. The curling iron 10 includes a handle portion 14 having therein an electric motor 36 adapted to rotate a curling mandrel 12. The motor 36, which may in one embodiment be a DC operated gear motor as for example, Model No. EN-29-R-5G3B, manufactured by the Canon Corporation, is coupled to a clutch assembly 38 having an adapter shaft 40 adapted to engage a portion of the mandrel 12.

The clutch assembly 38 is preferably a spring loaded face plate type of clutch and is adapted to slip if, the load on the motor 36 becomes too great. The clutch assembly 38 is a safety feature which prevents damage to the motor or injury to the user in the event that hair becomes caught in the rotating mandrel 12 or the motor control switch 32 fails. In such instances, the clutch will allow for slippage thereacross, thereby preventing harm or damage.

The mandrel 12 includes a heating element 42 disposed in the curling bar 16 in a generally coaxial relationship with the circumference thereof. The heater is typically a resistance type electrical heater preferably of the positive temperature coefficient (PTC type), that is to say the heating element's resistivity increases with increasing temperature thereof. Such heaters are essentially self-regulating in terms of temperature and power consumption and are well-known to those of skill in the art.

The motor 36 and the heater 42 are energized by electrical energy provided through a power cord 24 preferably having a rotary connection 44 associated therewith. Rotary connections, as are well-known to those of skill in the art, permit for electrical contact to be maintained while allowing for rotation of the interconnected elements. In this instance, the use of such a rotary connection 44 allows for rotation of the curling iron 10 while preventing kinking or twisting of the power cord 24. Electrical power from the rotary connection flows to the heater 42 via a pair of electrical wires **46*a*,46*b* via a slip ring assembly 48. Slip rings, as are well-known to those of skill in the electro-mechanical arts, are devices allowing for the communication of electrical power to a rotating shaft and the like. Such slip ring assemblies include a rotating set of contacts establishing sliding electrical communication. As illustrated herein, the slip ring assembly 48 includes a pair of rings 50 mounted for rotation on and with the mandrel 12. These rings 50 have associated therewith a pair of leads 52*a*,52*b* which communicate electrical power to the heater 42. The slip ring assembly 48 further includes a pair of contacts 54*a*,54*b* disposed in sliding electrical contact with the rings 50 so as to establish electrical communication between the electrical power leads 46*a*,46*b* and those rings 50**.

There is also included a heat level switch 28, in series with one of the power lines **46*a* to the heater 42. This switch may be a multi-position switch adapted to provide high and low levels of power to the heater or it may be a rheostat control switch adapted to continuously vary the power the heater. Such modifications are all within the ability of one of ordinary skill in the art and need not be elaborated upon further herein. There is also disposed an indicator lamp 30 in series with the electrical heater 42 for indicating when the heater is energized. The lamp may obviously be an incandescent lamp, a gas discharge lamp such as a neon lamp, a light emitting diode LED or the like. In other embodiments, the mandrel 12** may have a body of thermochromic material placed thereupon, to indicate by suitable color change when a proper hair curling temperature is reached.

The motor 36 is energized in a similar manner. However, electrical power is communicated thereto via a pair of switches as was mentioned previously. A first switch 26 is a motor speed selector switch and is adapted to provide preselected levels of power to the motor. Toward this end, the switch 26 may be a rheostat type switch adapted to continuously vary the power to the motor or it may be a stepwise acting switch adapted to provide various levels, as for example high, medium and low levels of power to the motor. In those instances where the motor 36 is a DC operated motor, the selector switch 26 or rotary connection 44 may have a rectifier such as a diode or the like associated therewith or interposed therebetween for purposes of providing direct current to the motor 36. Obviously, other combinations of speed and/or heat settings may be utilized. For example, the motor may be adapted to run at a single speed and in such instance the speed select switch 26, may be omitted. All such modifications should be apparent to one of skill in the art in light of the disclosure herein.

Electrical power is communicated from the selector switch 26 to a motor activation switch 32 which in the illustrated embodiment is a double-pole, double-throw switch. The switch 32 is adapted to initiate and terminate supply of electrical power to the motor 36 and is further adapted to selectively reverse the polarity of power supplied thereto so as to reverse rotation of the motor 36 in those instances where it is a DC motor. Accordingly, the motor activation switch 32 has four electrical leads communicating therewith. The first pair of leads **56*a*,56*b* provides power to the activator switch 32 for switching thereof. A first lead 56*a* communicates with the motor activation switch 32 via the speed selection switch 26 while a second lead 56*b* directly supplies power thereto. A second set of leads 58*a*,58*b* carry electrical power from the activation switch 32 to the motor 36. The electrical circuitry of the curling iron 10** will be explained in greater detail hereinbelow.

Also disposed within the housing of the handle 14 is an actuating lever 34 adapted to translationally displace a face plate 60 mounted on the front of the housing of the handle 14 for purposes of opening and closing the clamping member 18.

Referring now to Fig. 3A and 3B, the operation of the face plate 60 so as to bias the clamping member 18 between and open and closed position will be explained in greater detail. FIG. 3A depicts a portion of the mandrel showing the curling bar 16, the clamping element 18, and the face plate 60. It will be noted that the face plate 60 has a central opening therein and is disposed so that the mandrel passes through the central opening. The face plate 60 is typically made of a temperature-resistant material exhibiting a low coefficient of friction, among such materials are metals and various synthetic polymers such as nylon, Delrin, Teflon, and the like. The face plate 60 is capable of being translationally displaced along the length of the mandrel, in contact with the projecting portion 22 of the clamping member 18.

Referring to FIG. 3B, there is shown the manner in which displacement of the face plate 60 biases the clamping member 18 to its open position. The face plate 60 is translationally displaced by the actuating lever (34, shown in FIGS. 1 and 2) via a mechanical linkage, and when so displaced, cams the projecting portion 22 of the clamping member 18 so as to open that element. The clamping member 18 has a spring 62 associated with the pivot point 20 thereof for purposes of biasing the clamping member 18 to its closed position; and accordingly, release of the actuating lever will allow the spring 62 to return the clamping member 18 and faceplate 60 to the position illustrated in FIGS. 3A.

Referring now to FIG. 4A, there is shown one particular electrical circuit which may be employed in the curling irons of the present invention. The circuit of FIG. 4*a* is adapted to provide particular levels of electrical power to the motor 36 and heater 42. Components of the circuit illustrated in FIG. 4A are generally similar to those described with reference to the foregoing figures and accordingly will be referred to by similar reference numerals. Power is supplied to the circuit by an electrical cable 24. A first heater supply lead **46*a* communicates electrical power to the heater 42 via a heater select switch 28 and includes an indicator lamp 30 in series therewith. A second lead 46*b* completes the electrical connection to the heater 42**, it being understood that such communication is preferably established via a pair of slip rings as hereinabove discussed.

Electrical power is communicated to the motor 36 via a motor control switch 32 and a speed selection switch 26. Such communication is established via a first pair of leads **56*a*,56*b* which convey electrical power to the motor switch 32. The level of power supplied to the motor switch 32 is controlled by a speed select switch 26 which, as previously described, may be a rheostat type switch or a step type switch adapted to control the level of power provided to the motor switch 32. The power is communicated from the motor switch 32 to the motor 36 by a second pair of leads 58*a*,58*b*. The motor control switch 32 may be adapted to initiate and terminate electrical connection to the motor 36** as well as to reverse the polarity of electrical power supplied thereto so as to reverse rotation thereof.

As mentioned previously, the motor 36 is preferably a DC energized motor. The use of a DC motor confers several advantages in curling irons. DC motors are typically small sized and therefore allow for lightweight, compact appliances having a linear configuration. Additionally, use of DC motors allows for the ready, electrical control of motor rotation so as to provide for simple control of mandrel rotation.

In those instances where a DC motor is utilized, the circuit for its supply must include a source of DC power such as a rectifier 64. As shown herein, the rectifier 64 is disposed so as to rectify only electrical power supplied to the motor; however, other arrangement are possible. For example, a rectifier may be disposed so as to rectify the entire supply of current to both the heater and motor. In particular instances, it will be desirable to change the level of voltage supplied to the motor from that available through the power cable 24 and toward that end, the rectifier 64 may include a transformer for purposes of adjusting voltage before rectificiation.

Referring now to FIG. 4B, there is shown another circuit utilized to energize the motor 36 and heater 42 of the curling iron of the present invention. This embodiment is unique insofar as it employs a voltage divider circuit to control the voltage to the motor 36 and hence the rotational speed thereof. The notable feature of the circuit of FIG. 4B is that the heater element 42 is employed as a resistor element in the voltage divider circuit. Electrical communication is established to the heater 42 by leads **46*a*,46*b* generally as discussed previously and toward that end the circuit includes a heat select switch 28 and an indicator light 30. Power is also communicated to the motor 36 by one of the heater leads 46*a*. A second power connection to the motor 36 is established by a second motor lead 66 which taps power from the heater 42 itself. A motor activation switch 32 is imposed in series with this lead 66 so as to allow for control of the power supplied to the motor 36**. A circuit arrangement such as that of FIG. 4B simplifies the curling iron thereby allowing for savings in cost, materials and weight of finished product.

In those instances where the motor 36 is a DC motor, rectification of current supplied t both the heater 42 and the motor 36 will need to be implemented and can be readily accomplished by one of skill in the art. Additionally, the circuit of FIG. 4A may be modified so as to allow for control of rotation of the motor 36, in those instances where it is a DC motor by making switch **32*a* double-pole double-throw switch and modifying the circuitry so as to have leads 56*a* and 56*b* both communicating with the motor 32 through that reversing switch. It should be readily appreciated that the FIG. 4B embodiment may also be modified to provide the reversal of motor operation and in such instances additional slip ring 54*c* will have to be provided. Such rotary connection is necessary in order to enable power to be tapped from the heater 42 and conveyed to the motor 36**, while allowing for mandrel rotation. Such modifications are within the capabilities of one of ordinary skill in the art.

Many other modifications and variations of the present invention are possible within the scope of the disclosure herein. For example, the surfaces of the curling bar 16, and clamping element 18 may be coated with a high temperature resistant, synthetic polymeric material such as a fluorocarbon resin, as for example Teflon. Accordingly, it will be appreciated that the foregoing drawings and description are merely meant to be illustrative of the general principals of the instant invention and not limitations upon the practice thereof. It is the following claims, including all equivalents, which define the scope of the invention.

I claim:

1. A hair curling appliance including a curling mandrel rotatably supported by a handle, wherein:

(I) said mandrel comprise:

(a) an elongated, generally cylindrical curling bar, having a circumference and length and adapted to have a strand of hair wound thereabout, (b) a clamping element configured so as to conform to a portion of the circumference of the curling bar for at least a portion of the length thereof and pivotably attached to the curling bar so as to be biasable between a first position wherein said clamping element engages a circumferential portion of the curling bar and a second position wherein said element is pivoted out of engagement with said circumferential portion, said clamping element having a spring associated therewith for urging said element into said first position and (c) an electrical heater disposed internally of, and coaxial with the circumference of the curling bar; and wherein:

(II) the handle comprises an elongated outer casing, one end of said mandrel extending into the front end of said casing, said casing including therein:

(d) a motor assembly including an electrical motor having a clutch associated therewith and an adapter shaft engaging one end of said mandrel to said clutch so as to effect rotation of said mandrel relative to the casing, said motor and mandrel being disposed along the common linear central axis of said outer casing with said mandrel extending from the front end of said casing, (e) speed selection means adapted to provide a predetermined level of electrical power to the motor, said level corresponding to a predetermined mandrel rotational speed, (f) a motor activation switch interposed in series electrical communication with said speed selection means and said motor, said switch adapted to initiate and terminate supply of said predetermined level of power to the motor, (g) heater control means adapted to provide electrical power to said heater, the amount of power corresponding to the predetermined curling bar temperature, (h) a slip ring assembly disposed within said handle and associated with the curling bar, said assembly operative to establish electrical communication between the electrical heater and the heater control means, while allowing for rotation of the mandrel relative to said casing;

(i) clamping element actuating means for selectively biasing said element between said first position and said second position, said actuating means including a clamp actuating lever disposed on said outer casing, a face plate mounted in said casing for longitudinal movement along said linear axis and having a central opening therein and disposed so that the mandrel passes slidably and rotatably through the central opening, said face plate operably associated with the clamp activating lever so that operation of said lever translationally displaces the face plate along the central axis of the mandrel and wherein the clamping element further includes a projection adapted to engage the face plate so that the clamping element is biased from its first to its second position as the face plate is translationally displaced; and wherein:

(III) said motor activation switch and said clamp actuating lever are disposed in close proximity so as to be sequentially operable by a single digital stroke.

2. A hair curling appliance as in claim 1, wherein said motor is a direct current motor.

3. A hair curling appliance as in claim 2, further including a voltage divider adapted to supply power to the motor.

4. A hair curling appliance as in claim 3, wherein said heater is employed as a resistive element in and said voltage divider said slip ring assembly is further operative to provide for electrical communication between the heater and the motor.

5. A hair curling appliance as in claim 2, wherein the motor activation switch is further adapted to reverse the polarity of electrical power supplied the direct current motor whereby the direction of rotation of the motor and the mandrel may be selected

6. A hair curling appliance as in claim 1, wherein said speed selection means includes a switch adapted to provide high, medium and low levels of electrical power to the motor.

7. A hair curling appliance as in claim 1, wherein said heater control means includes a switch adapted to provide high and low levels of electrical power to the heater.

8. A hair curling appliance as in claim 1, wherein said mandrel and clamping element are formed from electroplated steel.

* * * * *